US008993883B2

(12) United States Patent
Kumakura et al.

(10) Patent No.: US 8,993,883 B2
(45) Date of Patent: Mar. 31, 2015

(54) DIFFERENTIAL SIGNAL TRANSMISSION CABLE

(75) Inventors: Takashi Kumakura, Hitachinaka (JP); Takahiro Sugiyama, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 512 days.

(21) Appl. No.: 13/331,545

(22) Filed: Dec. 20, 2011

(65) Prior Publication Data

US 2012/0152589 A1 Jun. 21, 2012

(30) Foreign Application Priority Data

Dec. 21, 2010 (JP) ..... 2010-284738

(51) Int. Cl.
*H01B 7/17* (2006.01)
*H01B 11/20* (2006.01)
*H01B 11/18* (2006.01)

(52) U.S. Cl.
CPC ..... *H01B 11/20* (2013.01); *H01B 11/183* (2013.01)
USPC ..... 174/36; 174/109

(58) Field of Classification Search
CPC ..... H01B 7/0861; H01B 7/0807
USPC ..... 174/36, 109
See application file for complete search history.

(56) References Cited

U.S. PATENT DOCUMENTS

| | | | | |
|---|---|---|---|---|
| 4,268,714 | A * | 5/1981 | Mori | 174/108 |
| 2001/0045296 | A1* | 11/2001 | Bailey | 174/36 |
| 2004/0026101 | A1 | 2/2004 | Ochi | |
| 2010/0108350 | A1* | 5/2010 | Cases et al. | 174/102 R |
| 2011/0247856 | A1* | 10/2011 | Matsuda et al. | 174/108 |

FOREIGN PATENT DOCUMENTS

| | | | |
|---|---|---|---|
| JP | 3-37719 | * | 4/1991 |
| JP | 2002-289047 | A | 10/2002 |

* cited by examiner

*Primary Examiner* — Chau N Nguyen
(74) *Attorney, Agent, or Firm* — McGinn IP Law Group, PLLC

(57) ABSTRACT

A differential signal transmission cable includes a pair of insulated electric wires disposed to be parallel with each other, and a shield layer formed of a metal foil composite tape spirally wound around the pair of insulated electric wires collectively. The shield layer is formed by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape.

18 Claims, 3 Drawing Sheets

DIFFERENTIAL SIGNAL TRANSMISSION CABLE

The present application is based on Japanese Patent Application No. 2010-284738 filed on Dec. 21, 2010, the entire contents of which are incorporated herein by reference.

BACKGROUND OF THE INVENTION

1. Field of the Invention

The present invention relates to a differential signal transmission cable, more particularly, to a differential signal transmission cable for transmitting high speed digital signals corresponding to 10 Gbps or more over a distance of several meters to several tens of meters with less signal waveform distortion.

2. Related Art

In servers, routers and storage associated equipments for processing high speed digital signals of several Gbps or more, differential signal transmission is used for signal transmission between devices or between boards in the same device, and a differential signal transmission cable is used for electrical connection therebetween.

The "differential signal transmission" is a signal transmission of transmitting two kinds of signals, in which a phase of one signal is inverted by 180 degrees from a phase of another signal, through a pair of two-conductor wires respectively, and by synthesizing and outputting a difference between the two signals at a receiving end side. Since electric current flown through one of the two-conductor wires and electric current flown through another one of the two-conductor wires are flown in directions opposite to each other, an electromagnetic wave radiated from the differential signal transmission cable which serves as a transmission line is small. Further, since extraneous noises equally superpose on the two-conductor wires, the extraneous noises are canceled (offset) by synthesizing and outputting the difference at the receiving end side, so that adverse influences by the extraneous noise can be eliminated. For these reasons, the differential signal transmission has been often used for high speed signals.

As a differential signal transmission cable, a twisted-pair cable has been known. In the twisted-pair cable, two insulated electric wires each of which has a conductor wire coated with an insulating member are twisted as one pair. The twisted-pair cable is inexpensive and excellent in balancing characteristics. Further, the twisted-pair cable can be easily bent. Therefore, the twisted-pair cable has been used broadly for a mid-distance signal transmission. However, since the twisted-pair cable has no conductor corresponding to a ground, the twisted-pair cable is easily affected by a metal member located in vicinity of the twisted-pair cable, so that characteristic impedance of the twisted-pair cable is not stable. Further, in the twisted-pair cable, a signal waveform is easily distorted in a high frequency band of several GHz. Therefore, it is difficult to employ the twisted-pair cable for the high speed signal transmission of several Gbps or more.

On the other hand, a so-called "twinax cable" in which two insulated electric wires are disposed in parallel without being twisted, and coated with a shield conductor has been used. The "twinax cable" is also called as "twin-axial cable" or "twin coaxial cable". In the twinax cable, the two insulated electric wires are disposed in parallel without being twisted, so that there is little difference in physical length between the two-conductor wires, compared with the twisted-pair cable. In addition, since the shield conductor is disposed to cover the two insulated electric wires, even if the metal member is installed in vicinity of the twinax cable, the characteristic impedance of the twinax cable will not become unstable, and the noise resistant property is high. The twinax cable has been used for the signal transmission at a relatively high speed over a short distance. In the twinax cable, for example, a tape with a metal foil (i.e. a metal foil composite tape), a braided wire and the like are used as a shield layer. A drain wire or the like may be provided together with the shield layer.

For example, FIG. 3 shows an example of conventional twinax cables disclosed by Japanese Patent Laid-Open No. 2002-289047 (JP-A 2002-289047). Referring to FIG. 3, in a conventional differential signal transmission cable 31, two signal transmission conductor wires 32, 32 are insulated by insulating members 33, 33, respectively to provide two insulated electric wires 34, 34, a drain wire 35 is lengthwise provided, a metal foil composite tape 38 in which a metal foil 37 is adhered to a plastic tape (plastic film) 36 is spirally wound around the two insulated electric wires 34, 34 and the drain wire 35, and a jacket 39 is provided to jacket the periphery of the metal foil composite tape 38 in order to protect the inside.

FIGS. 4A and 4B show another example of conventional twinax cables disclosed by Japanese Patent Laid-Open No. 2002-289047 (JP-A 2002-289047), similarly to the differential signal transmission cable 31. Referring to FIGS. 4A and 4B, in a conventional differential signal transmission cable 41, two signal transmission conductor wires 42, 42 are insulated by insulating members 43, 43, respectively to provide two insulated electric wires 44, 44, a metal foil composite tape 47 in which a metal foil 46 is adhered to a plastic tape 45 is lengthwise wrapped (in a manner of cigarette-wrapping) around the two insulated electric wires 44, 44 A drain wire 48 is lengthwise provided between the metal foil composite tape 47 and the insulated electric wires 44, 44 to contact a conducting plane (the metal foil 46) of the metal foil composite tape 47, to be grounded. An outer surface of the metal foil composite tape 47 is jacketed with a jacket 49 so as to protect the inside.

SUMMARY OF THE INVENTION

As described above, the twinax cables have been used widely as the differential signal transmission cable.

However, in the differential signal transmission cable 31 shown in FIG. 3, which comprises the shield layer formed by spirally winding the metal foil composite tape 38, the frequency characteristic as to the cable attenuation amount may have a sudden fall (i.e. rapid increase in the attenuation amount), namely so-called "suck-out" as shown in FIG. 5.

This phenomenon is caused by the following reasons. As shown in FIG. 6, the metal foil composite tape 38 comprises two layers, i.e. the metal foil 37 and the plastic tape 36. In an overlapped region 10 of the metal foil composite tape 38 when the metal foil composite tape 38 is spirally wound, the metal foil 37 of the metal foil composite tape 38 located inside the winding and the metal foil 37 of the metal foil composite tape 38 located outside the winding are electrically insulated from each other by the plastic tape 36, and this overlapped structure of the metal foil composite tape 38 periodically exists over the differential signal transmission cable 31. In general, an attenuation region appears around 12 GHz when a winding pitch is about 30 mm. In the signal transmission at several Gbps, there has been no problem since the high frequency band up to 12 GHz has not been required. However, the differential signal transmission cable for the high speed signal transmission at 10 Gbps or more for the next generation will be greatly influenced by the suck-out. For example, as to the signals at 25 Gbps, a fundamental wave (fundamental frequency) is 12.5 GHz, so that the signals will be largely attenuated by the suck-out around 12 GHz.

On the other hand, in the differential signal transmission cable 41 as shown in FIG. 4, which comprises the metal foil composite tape 47 that is lengthwise wrapped, since an overlapped region of the metal foil 46 does not periodically exist, the aforementioned "suck-out" does not occur. However, in the lengthwise wrapping, when the differential signal transmission cable 41 is bent, the expansion and contraction of the metal foil composite tape 47 cannot be absorbed due to its structure, so that the metal foil composite tape 47 may often warp, corrugate, or be broken.

If the warping or corrugation occurs in the differential signal transmission cable, the symmetry of the cable will be lost. As a result, there will be following disadvantages. Namely, so-called "skew" which is a difference in signal propagation clock time between the two-conductor wires may be increased, and EMI (Electromagnetic Interference) amount may be increased due to leakage of the electromagnetic field from a portion in which the symmetry of the cable is lost.

Therefore, the differential signal transmission cable 41 in which the meal foil tape 47 is lengthwise wrapped can be used only for the application of use in which the cable is hardly bent. Further, the aforementioned phenomena (the warping, corrugation and the like of the metal foil composite tape 47) may occur not only after finishing the cable fabrication but also in the "winding process" (the cable is wound on a winding reel), the "stranding process" or the like. Further, the aforementioned phenomena cause the deterioration of the production yield, so that the stable manufacturing is very difficult.

Accordingly, an object of the present invention is to provide a differential signal transmission cable for the high speed transmission at 10 Gbps or more, by which the attenuation amount in the frequency characteristics does not suddenly increase, which can bear the bending enough, and can be manufactured stably.

According to a feature of the invention, a differential signal transmission cable comprises:

a pair of insulated electric wires disposed to be parallel with each other; and a shield layer comprising a metal foil composite tape spirally wound around the pair of insulated electric wires collectively, in which the shield layer is formed by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape.

In the differential signal transmission cable, a width of the overlapped region is preferably ¼ or more of a tape width of the metal foil composite tape.

In the differential signal transmission cable, a width of the folded portion is preferably ¼ or more of a tape width of the metal foil composite tape.

In the differential signal transmission cable, the metal foil composite tape may comprise the metal foil adhered to one surface of a plastic tape.

According to another feature of the invention, a differential signal transmission cable comprises:

a two-conductor insulated electric wire comprising a pair of conductor wires disposed to be parallel with each other and an insulating member coating around the pair of conductor wires collectively;

a shield layer comprising a metal foil composite tape spirally wound around the two-conductor insulated electric wire, in which the shield layer is formed by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape.

In the differential signal transmission cable, a width of the overlapped region is preferably ¼ or more of a tape width of the metal foil composite tape.

In the differential signal transmission cable, a width of the folded portion is preferably ¼ or more of a tape width of the metal foil composite tape.

In the differential signal transmission cable, the metal foil composite tape may comprise the metal foil adhered to one surface of a plastic tape.

According to a still another feature of the invention, a differential signal transmission cable comprises:

a pair of insulated electric wires disposed to be parallel with each other; and a shield layer comprising a metal foil composite tape spirally wound around the pair of insulated electric wires collectively, in which the metal foil composite tape comprises a folded portion along a longitudinal direction of the metal foil composite tape, in which a portion of a metal foil of the folded portion contacts to and is electrically connected to a portion of the metal foil of the metal foil composite tape at a precedent pitch.

(Points of the Invention)

According to the present invention, a shield layer comprises a metal foil composite tape spirally wound around the pair of insulated electric wires collectively, and the shield layer is formed by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape. In other words, the metal foil composite tape comprises the folded portion along the longitudinal direction of the metal foil composite tape, and the metal foil of the folded portion contacts to and is electrically connected to a portion of the metal foil of the metal foil composite tape at a precedent pitch.

According to this structure, the metal foil of the metal foil composite tape is not electrically insulated from the metal foil of the metal foil composite tape at the precedent pitch in the overlapped region. Therefore, it is possible to provide a differential signal transmission cable for the high speed transmission at 10 Gbps or more, by which the attenuation amount in the frequency characteristics does not suddenly increase, which can bear the bending enough, and can be manufactured stably.

BRIEF DESCRIPTION OF THE DRAWINGS

The embodiment according to the invention will be explained below referring to the drawings, wherein:

FIGS. 4A and 4B show another conventional differential signal transmission cable, wherein FIG. 4A is a perspective view thereof, and FIG. 4B is a transverse cross sectional view thereof;

DETAILED DESCRIPTION OF THE EMBODIMENT

Next, a differential signal transmission cable in the embodiment according to the present invention will be explained below in more detail in conjunction with the appended drawings.

Figure 1:
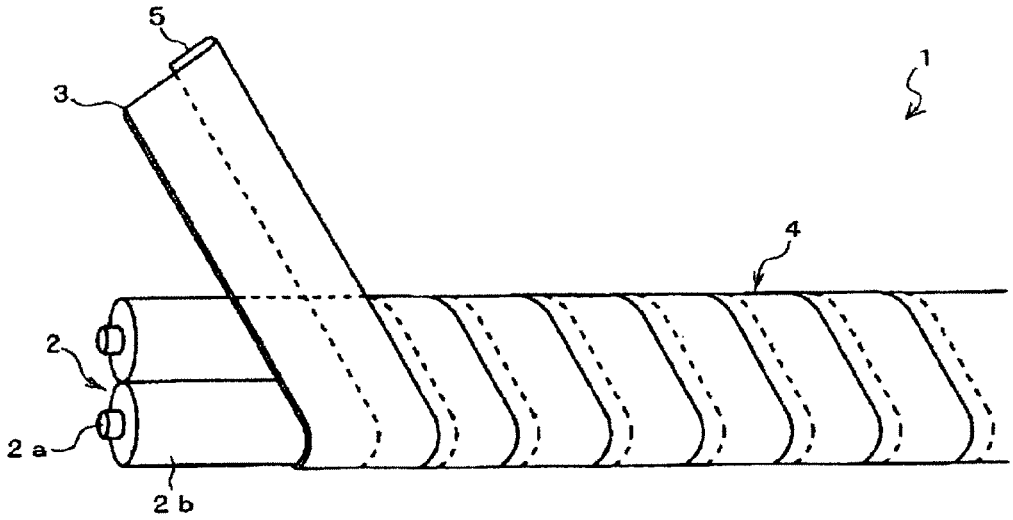
FIG. 1 is a perspective view of a differential signal transmission cable in an embodiment according to the present invention.
Figure 2:
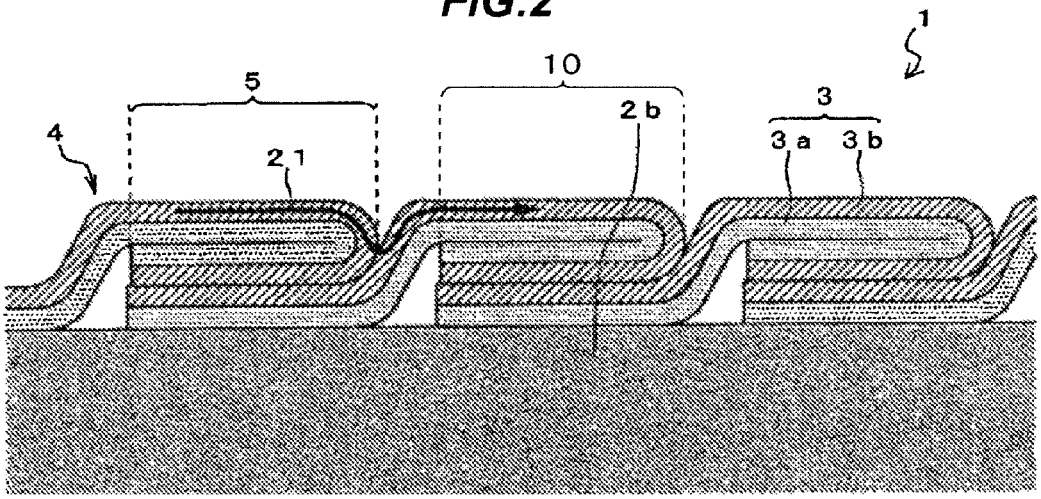
FIG. 2 is a partial lengthwise cross-sectional view of the differential signal transmission cable of FIG. 1, which shows a winding state of a metal foil composite tape.
Figure 3:
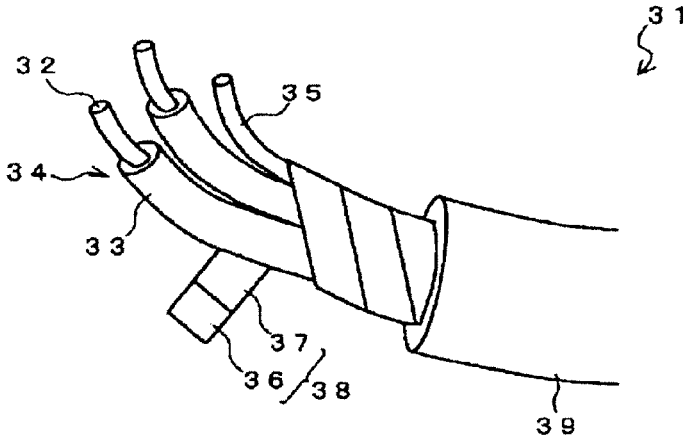
FIG.3 PRIOR ART
FIG. 3 is a perspective view of a conventional differential signal transmission cable.
Figure 4A:
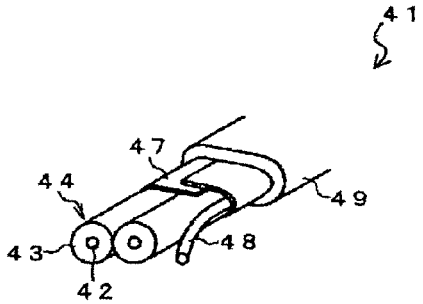
FIG.4A PRIOR ART
Figure 4B:
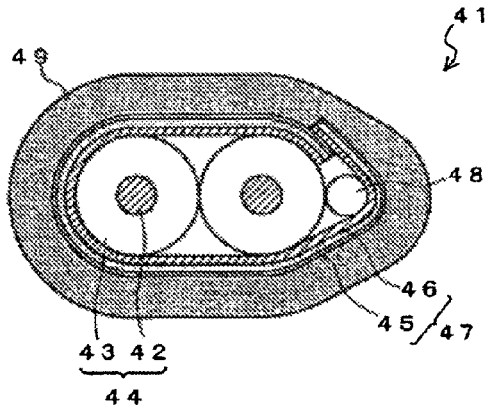
FIG.4B PRIOR ART
Figure 5:
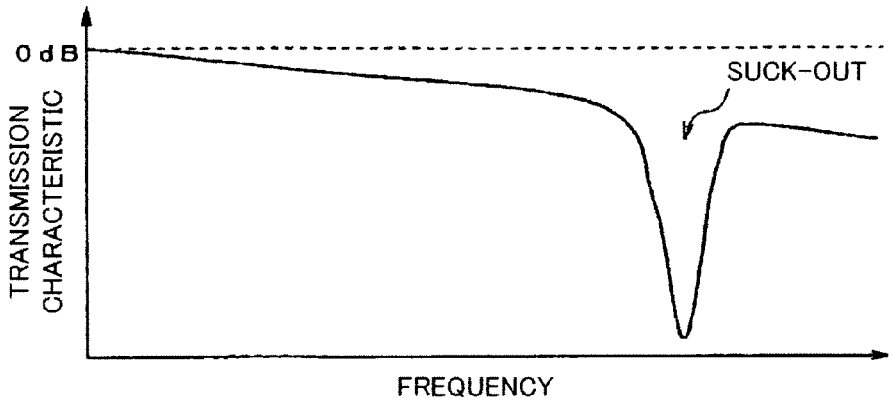
FIG. 5 is a graph showing a frequency characteristic of a cable attenuation amount in the conventional differential signal transmission cable of FIG. 3 for explaining the occurrence of "suck-out" which is a sudden increase in the attenuation amount.
Figure 6:
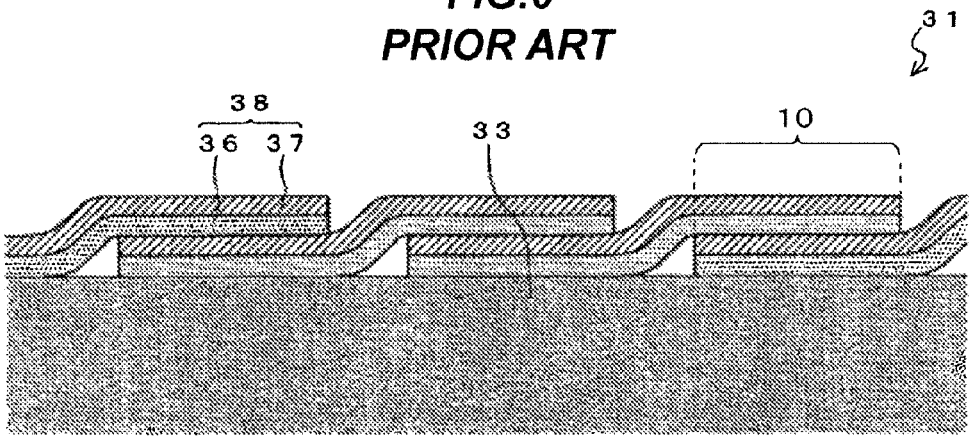
FIG.6 PRIOR ART
FIG. 6 is a partial lengthwise cross-sectional view of the conventional differential signal transmission cable of FIG. 3, which shows a winding state of a metal foil composite tape.

FIG. 1 is a perspective view of a differential signal transmission cable 1 in an embodiment according to the present invention. FIG. 2 is a partial lengthwise cross-sectional view of the differential signal transmission cable 1 of FIG. 1, which shows a winding state of a metal foil composite tape 3.

Referring to FIGS. 1 and 2, a differential signal transmission cable 1 in the embodiment according to the present invention comprises a pair of insulated electric wires 2, 2 disposed to be parallel with each other, and a shield layer 4 which comprises a metal foil composite tape 3 that is spirally wound around the pair of insulated electric wires 2, 2 collectively.

Each of the insulated electric wires 2, 2 comprises a conductor wire 2*a* for signal transmission, which is coated with an insulating member 2*b* having a predetermined dielectric constant.

As a material of the conductor wire 2*a* for signal transmission, a material having a high electrical conductivity (highly electroconductive material) such as copper, or a single wire comprising the highly electroconductive material coated with plating or the like may be used. When giving a weight to the bending property, a stranded wire may be used as the conductor wire 2*a*.

As a material of the insulating member 2*b*, it is preferable to use a material with a low dielectric constant and a low dielectric dissipation factor (dielectric tangent), e.g. polytetrafluoroethylene (PTFE), perfluoroalcoxy (PFA), polyethylene and the like. In addition, a foamable insulative resin may be used as the material of the insulating member 2*b*, in order to lower the dielectric constant and the dielectric dissipation factor. In the case of using the foamable insulative resin, it is preferable to use several known methods, e.g. a method of mixing a foamable agent into a resin before molding and controlling a foaming level of the resin by a molding temperature, a method of injecting a gas such as nitrogen into a resin by a molding pressure and foaming the resin at the time of pressure releasing, and the like.

As the metal foil composite tape 3 to be used as the shield layer 4, a composite tape in which a metal foil 3*b* such as copper, aluminum is adhered by bonding or vapor-deposition to one surface of a plastic tape (plastic film) 3*a* such as polyethylene tape is used.

In the differential signal transmission cable 1 in the embodiment, the shield layer 4 is formed by folding the metal foil composite tape 3 along a longitudinal direction of the metal foil composite tape 3 such that the surface on which the metal foil 3*b* is provided is located outside to provide a folded portion 5, and winding the metal foil composite tape 3 around an outer periphery of the pair of insulated electric wires 2, 2 such that at least a part of the folded portion 5 is located at a spiral overlapped region 10 of the metal foil composite tape 3.

In the embodiment of the present invention, the metal foil composite tape 3 is wound such that the folded portion 5 is located inside the winding (i.e. on the side of the insulating member 2*b*). In other words, the metal foil composite tape 3 is wound such that the metal foil 3*b* except the folded portion 5 of the metal foil composite tape 3 is located outside the winding. However, the present invention is not limited thereto, As long as at least a part of the folded portion 5 is located on the spiral overlapped region 10 of the metal foil composite tape 3, the metal foil composite tape 3 may be wound such that the folded portion 5 is located outside the winding.

At this time, a width of the overlapped region 10 (so-called, "lap ratio") when the metal foil composite tape 3 is spirally wound is preferably ¼ or more of a tape width of the metal foil composite tape 3. Further, a folding width of the metal foil composite tape 3, namely a width of the folded portion 5, is preferably ¼ or more of the tape width of the metal oil composite tape 3.

The object of setting both of the width of the overlapped region 10 and the width of the folded portion 5 to be ¼ or more of the tape width of the metal foil composite tape 3 is to wind and fix the metal foil composite tape 3 tightly such that the metal foil 3*b* of the metal foil composite tape 3 which is located inside the winding (on the side of the insulating member 2*b*) can sufficiently contact to the metal foil 3*b* of the folded portion 5 of the metal foil composite tape 3 which is located outside the winding.

On the other hand, in the overlapped region 10 of the metal foil composite tape 3, if the folded portion 5 of the metal foil composite tape 3 which is located inside the winding is overlapped with the folded portion 5 of the metal foil composite tape 3 which is located outside the winding, the thickness of the shield layer 4 will be excessively increased. Since the excessive increase in the thickness of the shield layer 4 is not desirable, the width of the overlapped region 10 is preferably less than a length obtained by subtracting the width of the folded portion 5 from the tape width of the metal foil composite tape 3, i.e. a width of a non-overlapped region of the folded portions 5. In the present embodiment, both of the width of the overlapped region 10 and the width of the folded portion 5 are set to be around ⅓ of the tape width of the metal foil composite tape 3. In practice, both of the width of the overlapped region 10 and the width of the folded portion 5 are set to be slightly less than the tape width of the metal foil composite tape 3 with considering the curving of the metal foil composite tape 3 at the overlapped region 10.

Around an outer periphery of the shield layer 4, although it is not shown in drawings, a jacket is preferably formed by extrusion-molding a thermoplastic resin such a polyethylene, polyvinyl chloride, fluorine resin.

Next, function and effect of the present embodiment will be explained below.

In the differential signal transmission cable 1 in the present embodiment, the shield layer 4 is formed by folding the metal foil composite tape 3 along the longitudinal direction of the metal foil composite tape 3 such that the surface on which the metal foil 3*b* is provided is located outside, and winding the metal foil composite tape 3 around an outer periphery of the pair of insulated electric wires 2, 2 such that at least a part of the folded portion 5 is located at the spiral overlapped region 10 of the metal foil composite tape 3.

According to this structure, a portion of the metal foil 3*b* of the folded portion 5 always contacts to and is electrically connected to a portion of the metal foil 3*b* of the metal foil composite tape 3 which is located inside the winding, namely, the metal foil composite tape 3 at a precedent pitch (i.e. at a location which is 1 pitch prior to the present location of the metal foil composite tape 3). Therefore, an electric current flown through the shield layer 4 in accordance with the signal transmission is flown along a longitudinal direction of the cable 1 as indicated by an arrow 21 in FIG. 2. In other words, the electric current flow is not restricted by the plastic tape 3*a*.

As described above, according to the differential signal transmission cable 1, although the metal foil composite tape 3 is spirally wound along longitudinal direction of the cable 1, there is no periodical insulated portion along the longitudinal direction of the cable 1 similarly to the cable in which the metal foil composite tape 3 is lengthwise wrapped, so that the suck-out does not occur.

Namely, according to the present invention, it is possible to provide a differential signal transmission cable 1, by which the attenuation amount according to the frequency characteristic does not suddenly increase (namely, the attenuation amount is small) when used for the high speed transmission at 10 Gbps or more. As a result, it is possible to realize the high speed signal transmission between the electronic devices and between the components in the electronic device, thereby contributes to the improvement in performance of the electronic device.

Further, according to the differential signal transmission cable 1, the shield layer 4 comprises the metal foil composite tape 3 which is spirally wound. Therefore, unlike the differential signal transmission cable in which the metal foil composite tape 3 is lengthwise wrapped, the metal foil composite tape 3 hardly warps or corrugates even though the cable 1 is bent, and the shield layer 4 is hardly broken.

Namely, according to the present invention, it is possible to provide the differential signal transmission cable 1 which can sufficiently bear the bending, and can be manufactured stably.

The present invention is not limited to the aforementioned embodiment, and various modifications can be made thereto without going beyond the scope of the present invention.

For example, in the embodiment of the present invention, the pair of insulated electric wires 2, 2 are disposed in parallel with each other and the metal foil composite tape 3 is spirally wound around the pair of insulated electric wires 2, 2 to provide the shield layer 4. However, the present invention is not limited thereto. In place of the pair of insulated electric wires 2, 2, it is possible to use a two-conductor insulated electric wire in which a pair of conductor wires disposed in parallel with each other and collectively coated with an insulating member.

Further, although it is not described in the embodiment, a drain wire may be attached as necessity.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A differential signal transmission cable, comprising:

a pair of insulated electric wires disposed to be parallel with each other; and a shield layer comprising a metal foil composite tape spirally wound around the pair of insulated electric wires collectively, wherein the shield layer is fowled by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape, wherein the metal foil composite tape spirally is wound around the pair of insulated electric wires such that the metal foil faces outwardly except the folded portion in which the metal foil faces outwardly and inwardly, wherein the differential signal transmission cable is configured to transmit signals at 10 Gbps or more, wherein the metal foil composite tape comprises a plastic tape, and wherein the plastic tape of the metal foil composite tape contacts the insulated electric wires over the differential signal transmission cable.

2. The differential signal transmission cable according to claim 1, wherein a width of the overlapped region is ¼ or more of a tape width of the metal foil composite tape.

3. The differential signal transmission cable according to claim 2, wherein a width of the folded portion is ¼ or more of a tape width of the metal foil composite tape.

4. The differential signal transmission cable according to claim 1, wherein a width of the folded portion is ¼ or more of the tape width of the metal foil composite tape.

5. The differential signal transmission cable according to claim 1, wherein the metal foil composite tape comprises the metal foil adhered to one surface of the plastic tape.

6. The differential signal transmission cable according to claim 1, wherein, in an area of the metal foil that faces outwardly except the folded portion in which the metal foil faces outwardly and inwardly, the metal foil is exposed to outside of the differential signal transmission cable.

7. The differential signal transmission cable according to claim 1, wherein the pair of insulated electric wires consists of conductor wires and insulating members.

8. The differential signal transmission cable according to claim 1, wherein each of the insulated electric wires comprises an insulating member comprising a foamable insulative resin.

9. The differential signal transmission cable according to claim 1, wherein no drain wire is provided in the differential signal transmission cable.

10. The differential signal transmission cable according to claim 1, wherein the differential signal transmission cable is configured to prevent suck-out.

11. The differential signal transmission cable according to claim 1, wherein the metal foil composite tape is wound spirally around the insulated electric wires such that the plastic tape faces inwardly except the folded portion in which the plastic tape faces inwardly and outwardly.

12. A differential signal transmission cable, comprising:

a two-conductor insulated electric wire comprising a pair of conductor wires disposed to be parallel with each other and an insulating member coating around the pair of conductor wires collectively; and a shield layer comprising a metal foil composite tape spirally wound around the two-conductor insulated electric wire, wherein the shield layer is formed by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape, wherein the metal foil composite tape spirally is wound around the two-conductor insulated electric wires such that the metal foil faces outwardly except the folded portion in which the metal foil faces outwardly and inwardly, wherein the differential signal transmission cable is configured to transmit signals at 10 Gbps or more, wherein the metal foil composite tape comprises a plastic tape, and wherein the plastic tape of the metal foil composite tape contacts the insulated electric wires over the differential signal transmission cable.

13. The differential signal transmission cable according to claim 12, wherein a width of the overlapped region is ¼ or more of a tape width of the metal foil composite tape.

14. The differential signal transmission cable according to claim 13, wherein a width of the folded portion is ¼ or more of the tape width of the metal foil composite tape.

15. The differential signal transmission cable according to claim 6, wherein a width of the folded portion is ¼ or more of a tape width of the metal foil composite tape.

16. The differential signal transmission cable according to claim 12, wherein the metal foil composite tape comprises the metal foil adhered to one surface of the plastic tape.

17. The differential signal transmission cable according to claim 12, wherein the metal foil is not in a direct contact with the insulated electric wires.

18. A differential signal transmission cable, comprising:

a pair of insulated electric wires disposed to be parallel with each other; and a shield layer comprising a metal foil composite tape spirally wound around the pair of insulated electric wires collectively, wherein the shield layer is formed by folding the metal foil composite tape along a longitudinal direction of the metal foil composite tape such that a surface on which a metal foil is provided is located outside to provide a folded portion, and winding the metal foil composite tape around the pair of insulated electric wires such that at least a part of the folded portion is located at a spiral overlapped region of the metal foil composite tape, wherein the metal foil composite tape spirally is wound around the pair of insulated electric wires such that the metal foil faces outwardly except the folded portion in which the metal foil faces outwardly and inwardly, wherein the differential signal transmission cable is configured to transmit signals at 10 Gbps or more, wherein the metal foil is not in a direct contact with the insulated electric wires.

* * * * *